US006439093B1

(12) United States Patent
Davies

(10) Patent No.: US 6,439,093 B1
(45) Date of Patent: Aug. 27, 2002

(54) SHEET PUNCH DEVICE

(76) Inventor: Michael Anthony Davies, 731 Butterfield Rd., San Anselmo, CA (US) 94978

( * ) Notice: Subject to any disclaimer, the term of this patent is extended or adjusted under 35 U.S.C. 154(b) by 265 days.

(21) Appl. No.: 09/109,016

(22) Filed: Jul. 1, 1998

(51) Int. Cl.[7] ..... B26F 1/14
(52) U.S. Cl. ..... 83/687; 83/633; 83/636
(58) Field of Search ..... 83/618, 620, 633, 83/634, 635, 683, 682, 681; 412/16; 402/79; 428/132; 281/38

(56) References Cited

U.S. PATENT DOCUMENTS

| | | | | | |
|---|---|---|---|---|---|
| 680,599 | A | * | 8/1901 | Jones et al. | 269/319 |
| 702,698 | A | * | 6/1902 | Bowen | 83/618 |
| 1,023,715 | A | * | 4/1912 | Bristol | 402/79 |
| 1,443,092 | A | * | 1/1923 | Pettis | 402/79 |
| 1,911,398 | A | * | 5/1933 | Schade | 402/31 |
| 2,382,523 | A | * | 8/1945 | Unger | 83/633 |
| 2,651,363 | A | * | 9/1953 | Hooe | 83/683 |
| 3,073,199 | A | * | 1/1963 | Yerkes | 83/633 |
| 3,274,869 | A | * | 9/1966 | Piazze | 83/683 |
| 3,807,261 | A | * | 4/1974 | Couvreur | 83/6 |
| 3,808,933 | A | * | 5/1974 | Buan | 83/633 |
| 4,036,088 | A | * | 7/1977 | Ruskin | 83/633 |
| 4,354,405 | A | * | 10/1982 | Szanto et al. | 83/13 |
| 4,449,434 | A | * | 5/1984 | Johnson | 83/682 |
| 4,688,457 | A | * | 8/1987 | Neilsen et al. | 83/633 |
| 5,487,634 | A | * | 1/1996 | Vercillo | 412/16 |
| 5,967,786 | A | * | 10/1999 | Wang | 434/81 |
| 6,074,330 | A | * | 6/2000 | Ostini | 483/29 |
| 6,189,414 | B1 | * | 2/2001 | Yoshizawa et al. | 76/107.8 |

* cited by examiner

*Primary Examiner*—Allan N. Shoap
*Assistant Examiner*—Jason Prone
(74) *Attorney, Agent, or Firm*—Virginia H. Meyer

(57) ABSTRACT

In one aspect, the present invention is an oversized sheet of paper having one or more punch outs for a standard sized ring binder and at least one cutout opening therein that allows the oversized paper to be secured in a standard sized ring binder when the oversized paper is folded at 90 degrees relative to the binding edge, and further allows the oversized paper to be unfolded for viewing without releasing a ring of the ring binder. In another aspect, the present invention comprises paper punches and cutting devices, operable by a user, which make at least one cutout in an oversized sheet of paper that allows the oversized paper to be secured in a standard sized ring binder when the oversized paper is folded, at 90 degrees relative to the binding edge, and further allows the oversized paper to be unfolded for viewing without releasing a ring of a ring binder.

11 Claims, 8 Drawing Sheets

SHEET PUNCH DEVICE

FIELD OF THE INVENTION

This invention relates to oversized paper that is punched or otherwise cut so the paper can be stored in standard sized ring binders, and to paper punches and cutters that make it possible for oversized paper to be adapted for storage in ring binders that are smaller than the oversized paper.

BACKGROUND OF THE INVENTION

Correspondence, reports and documents are most often printed on paper of so-called standard sizes, that is, on paper of sizes that have come to be commonly used in a given situation or in a given field. In the United States and some other countries, paper that measures 8½ by 11 inches is the standard size used by most businesses, most schools, and by many individuals. The 8½ by 11 inch paper is sometimes referred to as "letter sized" paper. Many file cabinets and many file binders, including ring binders, are sized to hold "letter sized" paper. However, in some other fields, law for example, larger sized paper is the standard. In law, standard sized paper measures 8½ by 13 inches or 8½ by 14 inches. Many legal documents, including pre-printed legal agreements, are printed on "legal sized" paper that is 8½ by 13 or 8½ by 14 inches. There are file cabinets and file binders sized to hold legal sized paper, and these are extensively used by those in fields where legal sized paper is the standard. Legal sized file cabinets and file binders are used less by those who use letter sized paper in the normal course of their affairs.

Sometimes those who use letter sized paper will also have a document or agreement that is printed on legal sized paper, and those who use the letter sized paper will want to file the oversized legal document along with their letter sized papers. This can be done in a non-bound file folder by merely folding the legal sized document so it fits in the non-bound file folder. However, if the letter sized papers are bound for example, in a letter sized "left side edge" ring binder, the folded legal paper will not fit within the letter sized binder unless the oversized legal paper is folded 90 degrees relative to the ring binder's edge, and then additional ring binder punch outs are punched through the left folded edge of the oversized legal paper. This solution works as long as the contents of the oversized legal paper under the "fold" do not have to be viewed. If they do, it is necessary for the viewer to open the rings on the ring binder, and take out from the ring binders at least the folded portion of the oversized legal document. This is not convenient.

Thus there is a need for an oversized sheet of paper that can be folded for storage in a smaller sized ring binder and further adapted in such a way as to provide a secure binding of the folded oversized sheet, and yet still allow access to the entire oversized sheet when it is unfolded, without opening the loose leaf binder rings. Furthermore, there is a need for users to be able to create the necessary punch outs and cutouts in oversized sheets of paper lacking such, so as to make oversized sheets conveniently storable in smaller sized ring binders. These punch outs and cutouts can be created by suitable paper punches or cutters, alone or in combination with punches that create standard punch outs for standard ring binders.

OBJECTS OF THE INVENTION

An object of the invention is to provide a sheet of paper that is oversize for the ring binder in which it is stored, yet can be folded to fit within the binder, and unfolded without the necessity of opening any of the binder rings.

Another object is to provide punch means that will make a cutout in an oversized sheet of paper not having the cutout invention.

Yet another object of the invention is to provide a fold line indicator on an oversized sheet of paper that indicates where the paper should be folded in order to utilize the properties of the invention.

SUMMARY OF THE INVENTION

In one aspect, the present invention is an oversized sheet of paper having one or more punch outs for a standard sized ring binder and at least one cutout therein that allows the oversized paper to be bound in a standard sized ring binder when the oversized paper is folded at 90 degrees relative to binding edge, and further allows the oversized paper to be unfolded for viewing without releasing the ring binders of the standard sized ring binder.

In one form, the oversized paper of the invention has at least one punch out through which a ring on a standard ring binder can pass, and at least one cutout therein extending to the edge of the paper that will be bound within the ring binder. For example, when the oversized paper is legal sized paper measuring 8½ by 14 inches, and the storage binder is a 3-ring binder designed to store 8½ by 11 inch letter sized paper, the cutout of the present invention will be on the left lateral edge of the oversized paper.

According to the invention, the cutout(s) can be of any shape that allows the bound oversized paper, when folded 90 degrees relative to the binding edge, to lie relatively flat in the binder without interference or obstruction from the binder rings, and still be unfolded without opening the binder rings. Various possible shapes of cutouts are illustrated in FIGS. 1, 3, 4 and 5. In preferred form, the cutout will have a first cutout portion that allows a ring of a ring binder to pass through it without interference when it is in a folded position, and a second cutout portion that extends the cutout to the binding edge of the oversized paper. In a most preferred form, the first cutout portion will have a "standard" punch out that will partially encircle the binder ring(s), which would otherwise obstruct and prevent the folded oversized paper from lying flat in the binder. Also in a most preferred form, the second cutout portion will be a narrow neck extending from the rounded circular edges of the first portion of the cutout, to the binding edge of the paper, the neck having either straight or curvilinear parallel sides. In another preferred form, the narrow neck of the second cutout portion is flared at the paper edge, giving this cutout a keyhole shape. Other preferred forms include cutouts with divergent straight or curvilinear sides. By means of any of such cutouts, the oversized paper can be folded and bound in the standard sized binder, and still unfolded for viewing without opening the binder rings.

In another form, a portion of the corner of the oversized paper is removed (or perforated so it can be torn away by the user) so that when the oversized paper is folded 90 degrees relative to binding edge, the cutout allows the fold of the oversized paper to fit within the binder without touching the binding rings. For example, if the binder is a 3-ring binder for 8½ by 11 inch letter sized paper, and the paper is legal sized, measuring 8½ by 14 inches, a rectangular section is cutout from the lower left corner of the legal sized paper so that when the 8½ by 14 inch legal sized sheet is folded 90 degrees relative to the binding edge of the paper, and punched with a standard 3-hole punch, the legal sized paper can be folded and stored in the letter sized 3-ring binder and unfolded for viewing without releasing the ring binders.

The oversized paper may include a "fold line indicator" to show where the oversized paper is to be folded, so the oversized paper will be storable in a binder of smaller size according to the teaching of the invention. The fold line may be indicated by an ink stamp, an embossed mark, a cut, such as a notch, or any other means that indicates where the oversized paper is to be folded.

In another aspect, the present invention comprises paper punches and cutting devices, operable by a user, which make at least one cutout in an oversized sheet of paper that allows the oversized paper to be secured in a standard sized ring binder when the oversized paper is folded, at 90 degrees relative to the binding edge, and further allows the oversized paper to be unfolded for viewing without releasing the ring binders of the standard sized ring binder.

The cutout punch can be single, that is, one which only makes a cutout of the invention and is not associated with any other type of punch device, such as a standard three-hole punch. Alternatively, the cutout punch of the invention can be incorporated as part of a punch device that produces standard punch outs for a ring binder. In its single form, the punch can be used to add a cutout to a sheet of paper that contains standard ring binding holes, so as to allow easy storage of the oversized sheet in a standard sized ring binder. In its incorporated form, the cutout punch of the invention will be incorporated into standard hole punching devices. The cutout punch of the invention may be incorporated into standard three hole punches, either the heavier desk top types or the portable types made to be carried from place to place, in book bags or ring binder, for example. In this form a punch device that is designed to make standard punch outs for a ring binder will have an additional cutout punch placed as to create the cutout in the location needed to allow the oversize paper to be stored in a folded condition.

When the cutout punch of the invention is incorporated into standard punches, means for indicating the fold line can also be incorporated into the punches. For example, the fold line may be indicating by a fold line indicator punch head incorporated into a standard desk top punch, along with the cutout punch of the invention.

This invention is applicable to any binding methods that operate by having pre-formed or user-formed holes in the paper, no matter what the shape, material, or location of the binding ring or other binding device. Thus, the invention applies also to those bindings at which the holes are on the upper edge of the paper, and for which it is desirable to bind an oversize paper folded along either the right or left edges, or both, in a manner which permits the paper to be folded and unfolded without interference from a ring of a ring binder or without the necessity of opening a binder ring.

DEFINITIONS

For use in the present specification and claims, the terms of art listed below are defined as follows:

Oversized sheet of paper: A sheet of paper that is too large to fit in chosen storage means without modification. The portion of the oversized sheet of paper that does not fit within the chosen storage means is the non-standard size portion of the oversized sheet of paper. An example of an oversized sheet of paper is a legal sized sheet of paper that one wants to store in a standard letter sized ring binder.

Punch Out: A punch out is an area in a sheet of paper from which the paper has been removed so that a ring of a standard ring binder can pass therethrough. To be bound in a standard three ring binder an oversized sheet of paper has three colinear punch outs: a first outer punch out, a middle punch out and second outer punch out. A standard punch out is round.

Ring Binder: A method of holding sheets of paper in a binder using punch outs in the paper and a ring which passes through the punch outs.

Cutout: A cutout is an area in an oversized piece of paper from which the paper has been removed. A cutout of the invention can be any shape that extends to the edge of the paper that will be bound within a ring binder and allows a non-standard size portion of an oversized sheet of paper to be folded 90 degrees relative to the binding edge and unfolded without interference from a ring of a ring binder or without the necessity of opening a binder ring.

Fold Line: A fold line is a line perpendicular to the binding edge of an oversized sheet of paper, along which the oversized sheet of paper is folded such that the cutout and punch out are aligned.

Fold Line Indicator: A printed, embossed, slit, or cut marking on an oversized piece of paper indicating the position of the fold line.

BRIEF DESCRIPTION OF THE DRAWINGS

In the drawings:

FIGS. 3(*a, b, c, d, e* & *f*) shows plan views of the lower part of the sheet of paper shown in FIG. 1.

FIGS. 4(*a, b, c* & *d*) shows the keyhole cutout punch head and corresponding die of the invention.

FIGS. 8(*a, b, c* & *d*) shows fold line indicator punch head that creates a notch fold line indicator of the invention and its corresponding die.

DETAILED DESCRIPTION

First Preferred Embodiment

Figure 1:
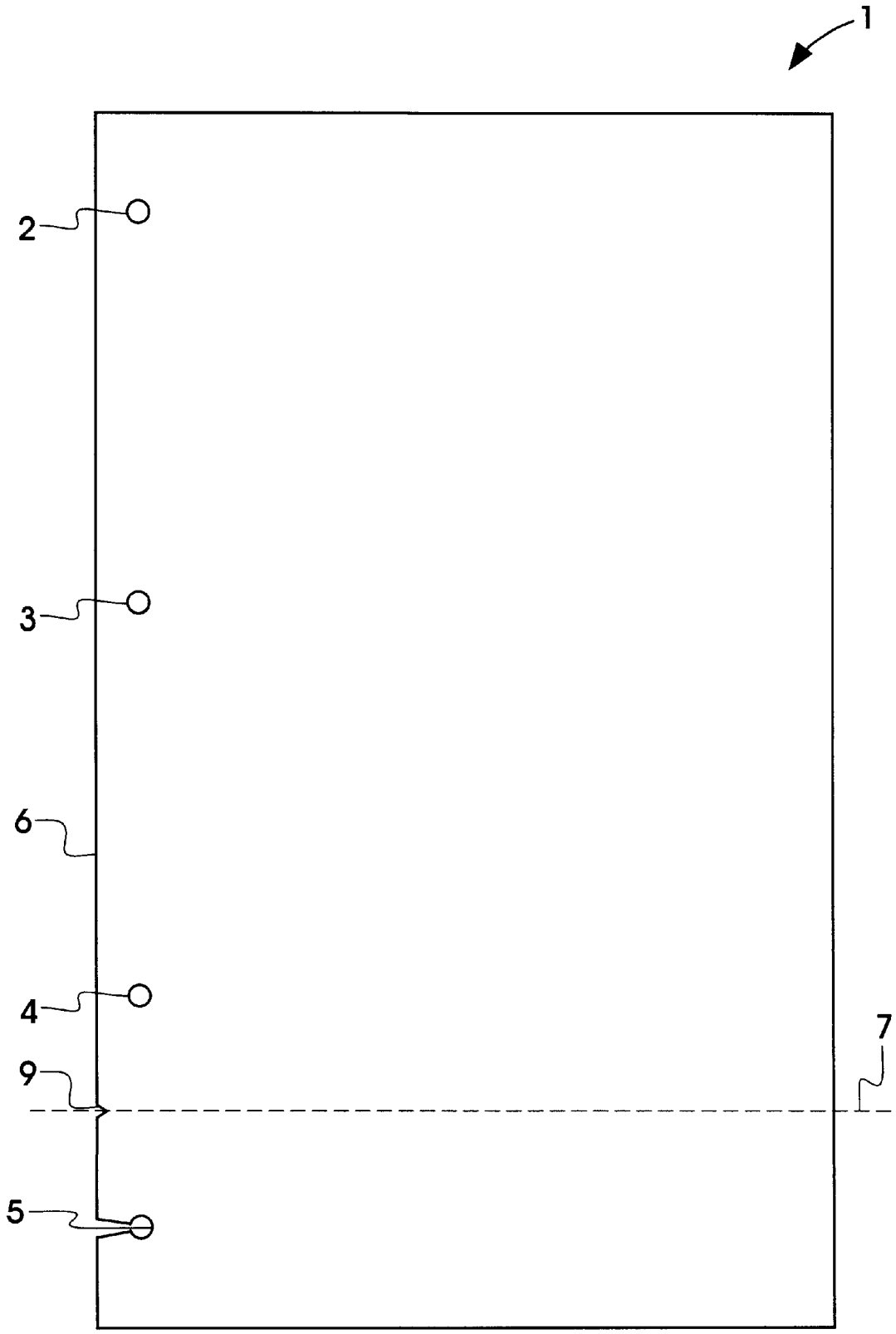
FIG. 1 is a plan view of an oversized sheet of paper containing standard punch outs for a three-ring binder, a cutout of the invention, plus a notch shaped fold line indicator of the invention.
Figure 2:
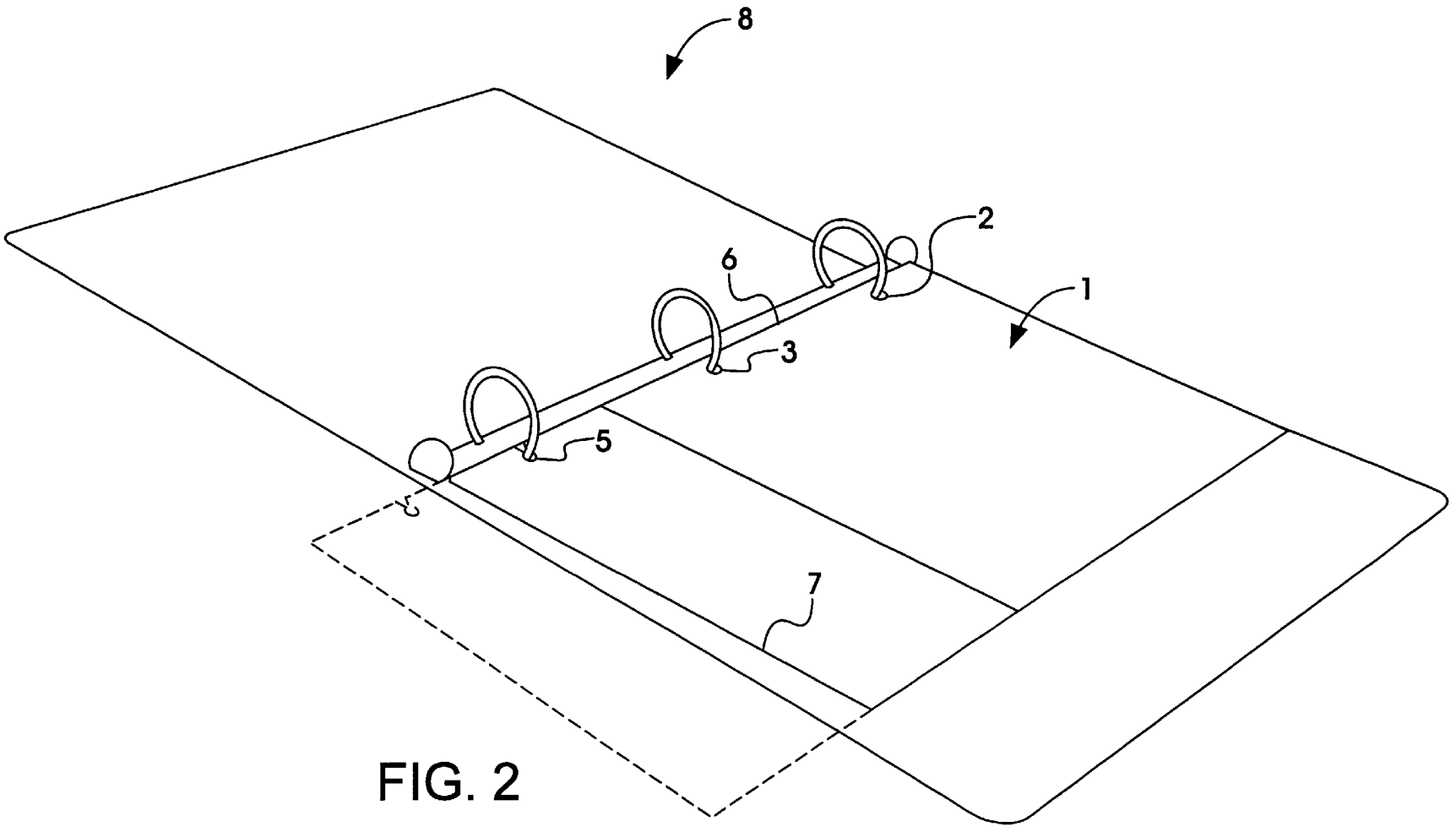
FIG. 2 is a plan view showing an oversized sheet of paper with a first outer punch out, a middle punch out, a second outer punch out, and a cutout of the invention, folded and in place in a standard 3-ring binder.
Figure 3A:
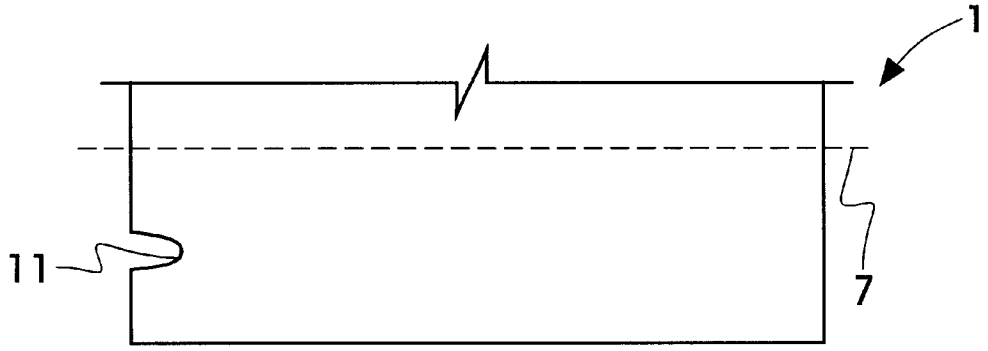
FIGS. 3*a* through 3*f* illustrate different-shaped cutouts of the invention.
Figure 3B:
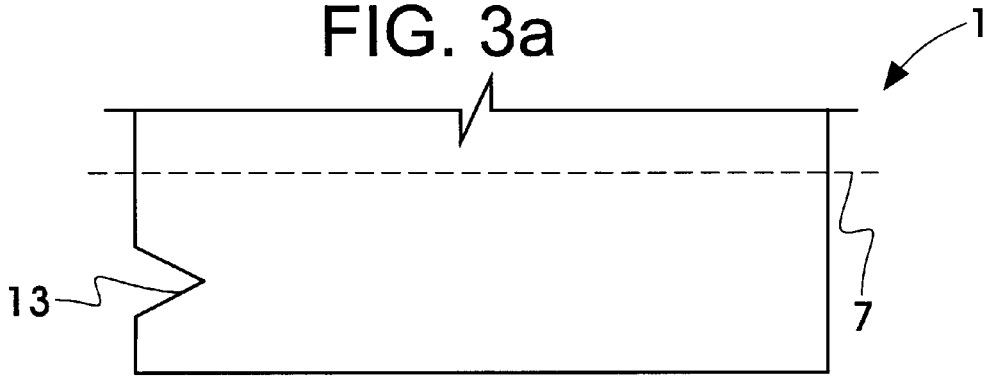
Figure 3C:
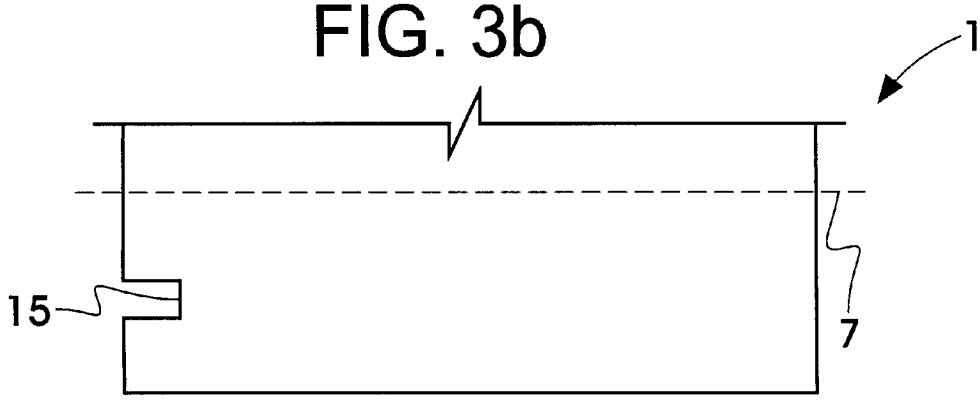
Figure 3D:
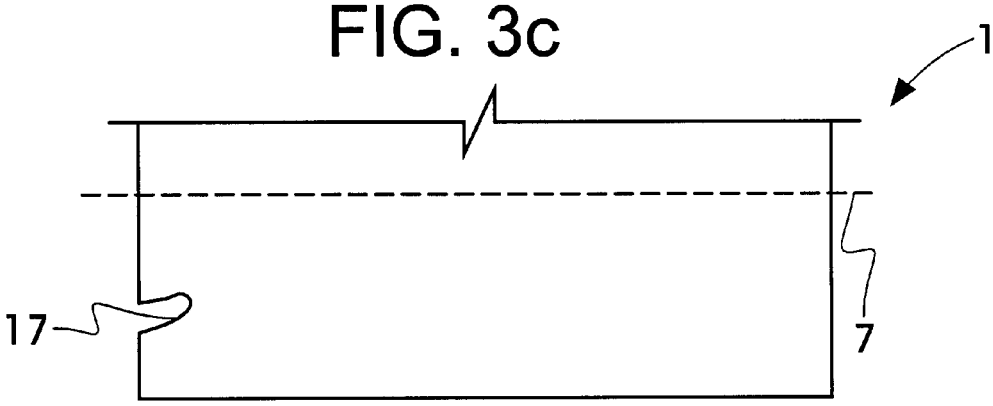
Figure 3E:
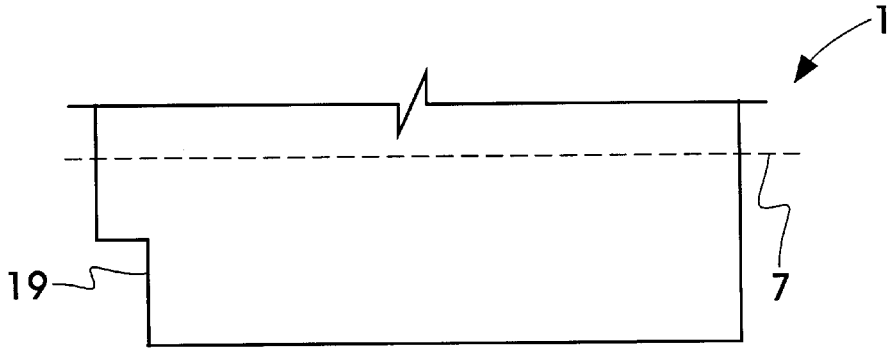
Figure 3F:
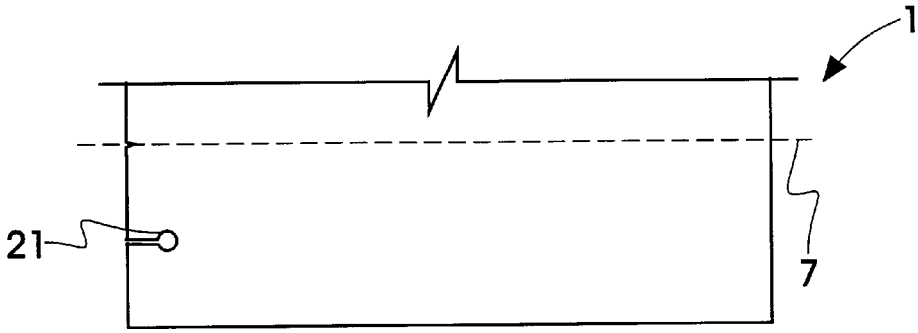

FIG. 1 shows a plan view of oversized sheet of paper 1 that has three standard punch outs, first outer punch out 2, middle punch out 3, and second outer punch out 4, fold line 7, fold line indicator 9, and cutout 5. First outer punch out 2, middle punch out 3, and second outer punch out 4 are placed to allow oversized sheet of paper 1 to be bound in standard 3-ring binder 8. Cutout 5 is so placed that when paper 1 is folded along line 7, second outer punch out 4 and the cutout 5 are aligned. When the paper is so folded, its size is such that it may be bound within standard 3-ring binder 8. (See FIG. 2.)

Cutout 5 is a keyhole shape having a first and second portion. The first cutout portion allows a ring of a ring binder to pass through it without interference when it is in a folded position. The second cutout portion extends cutout 5 to binding edge 6. Because cutout 5 reaches the binding edge 6 of oversized sheet of paper 1, paper 1 may be placed in binder 8 and be folded, unfolded and refolded to reveal the entire length of the oversized sheet while the sheet remains bound by the three standard rings without the necessity of opening any of the rings. (See FIG. 2.)

Fold indicator means 9 provides a visual mark to help the user readily locate the position of fold line 7 before folding paper 1 along line 7. The fold indicator means may be any means for indicating where to fold oversized sheet of paper 1. The fold indicator means may be a cutout, a slit, an ink mark, or an embossed mark. An example of a fold indicator means 9 is a notch shown in FIG. 1.

As shown in FIG. 3, other cutout shapes can also be utilized in this invention. All cutouts are so placed that when paper 1 is folded along line 7, second outer punch out 4 and any cutout of the invention will align, allowing the oversized paper to be placed within a three-ring binder. FIG. 3*a* shows oval cutout 11. FIG. 3*b* shows triangular cutout 13. FIG. 3*c* shows rectangular cutout 15. FIG. 3*d* shows curvilinear cutout 17. The shape of cutout 17 is optimized to allow the binder ring to pass along the cutout from the binding edge towards the final position with minimal bending of the paper. FIG. 3*e* shows corner cutout 19. Corner cutout 19 is shaped by removing paper from both the binding edge and the immediately-adjacent edge of the sheet. FIG. 3*f* shows slit cutout 21.

The exact shape and course of the cutout of the invention is not critical as long as the cutout extends to the edge over the oversized paper and aligns with outer punch out 4 allowing the oversized sheet of paper to be placed in a binder so that the non-standard portion of an oversized sheet of paper may be folded 90 degrees relative to the binding edge and unfolded without interference from a ring of the ring binder or without the necessity of opening a binder ring.

Method of Making the Invention

The method of making the paper of the invention provides a user with a means to create one or more cutouts of the invention in a piece of paper not having such a cutout. The cutouts for a single sheet or a number of sheets can be made using standard punch techniques known in the art.

Figure 4A:
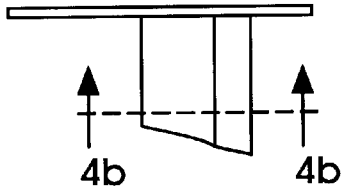
FIG. 4*a* shows a side view of a cutout punch head that makes a keyhole-shaped cutout.
Figure 4C:
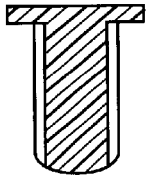
FIG. 4*c* is an end view of the cutout punch head of FIG. 4*a*.
Figure 4B:
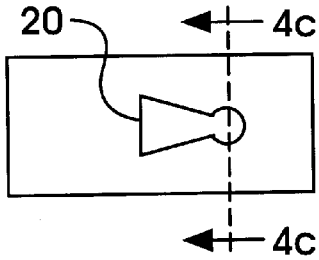
FIG. 4*b* shows a plan view of the cutout punch head of FIG. 4*a*.
Figure 4D:
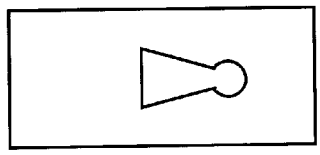
FIG. 4*d* is a plan view of the die corresponding to the cutout punch head of FIG. 4*a*.
Figure 5A:
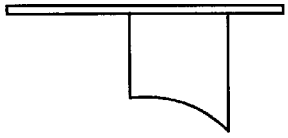
FIGS. 5*a*, 5*c*, 5*e*, 5*g*, 5*i* & 5*k* show side views of the cutout punch heads. Plan views of the cutout punch heads are shown in FIGS. 5*b*, 5*d*, 5*f*, 5*h*, 5*j* & 5*l*.
Figure 5C:
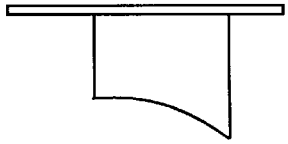
Figure 5E:
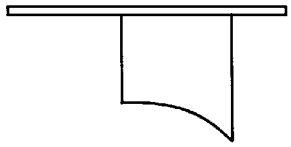
Figure 5B:
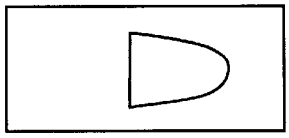
FIGS. 5(*a, b, c, d, e, f, g, h, i, j, k* & *l*) shows a collection of cutout punch heads.
Figure 5D:
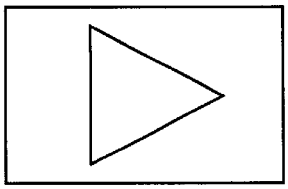
Figure 5F:
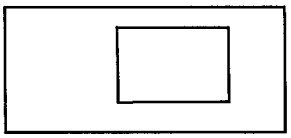
Figure 5G:
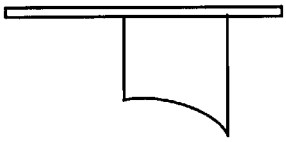
Figure 5I:
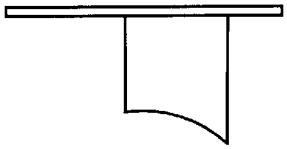
Figure 5K:
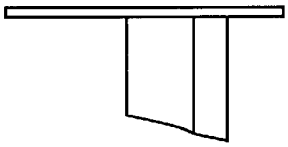
Figure 5H:
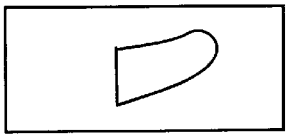
Figure 5J:
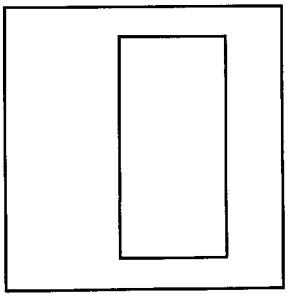
Figure 5L:
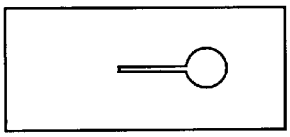

FIG. 4*b* shows the plan view of a cutout punch head that will make keyhole cutout 5 shown in FIG. 1. FIG. 4*a* is a side view and FIG. 4*c* is an end view of the cutout punch head shown in FIG. 4*b*. FIG. 4*d* shows the die that works in cooperation with the cutout punch head shown in FIGS. 4*a*, *b* and *c* to make keyhole cutout 5. As shown in FIG. 3, other cutouts can also be utilized in this invention.

Cutout punch head of FIG. 4*a* is shaped to increase cutting efficiency. The bottom of the punch is shown angled and beveled so as to start the cutting at the edge of the cutout farthest from the binding edge, and then to continue the cutting in a direction towards the binding edge.

The cutout punch head (see FIGS. 4*a*, 4*b* and 4*c* ) and its corresponding die (see FIG. 4*d* ) can be mounted in any of a number of ways known in the art for aligning a punch and die, and for providing a means of forcing the punch through the paper and die. The paper is placed on top of the die and then the cutout punch shown in FIG. 4*a* is moved downward, cutting the paper and creating keyhole cutout 5 shown in FIG. 1. It is not necessary for the binding edge of the paper to be co-incident with edge 20 of the die. If the paper is not co-incident with the edge of the die, it is not necessary for there to be any cutting action of the punch and die along edge 20.

The cutout punch heads of FIG. 5 and their corresponding dies make the cutout of the invention in the manner described in detail above for the punch head and die of FIG. 4. Cutout punch head of FIGS. 5*a* and *b* and its corresponding die work in cooperation to make oval cutout 11 shown in FIG. 3*a*. Cutout punch head of FIGS. 5*c* and *d* and its corresponding die work in cooperation to make triangular cutout 13 shown in FIG. 3*b*. Cutout punch head of FIG. 5*e* and d and its corresponding die work in cooperation to make rectangular cutout 15 shown in FIG. 3*c*. Cutout punch head of FIGS. 5*g* and *h* and its corresponding die work in cooperation to make curvilinear cutout 17 shown in FIG. 3*d*. Cutout punch head of FIGS. 5*i* and *j* and its corresponding die work in cooperation to make comer cutout 19 shown in FIG. 3*e*. Cutout punch head of FIGS. 5*k* and *l* and its corresponding die 5*l* work in cooperation to make slit cutout 21 shown in FIG. 3*f*. The cutout punch heads of FIGS. 5*a* and *b*, 5*c* and *d*, 5*e* and *f*, 5*g* and *h*, 5*i* and *j*, and 5*k* and *l* are also shaped to increase cutting efficiency.

Second Preferred Embodiment

Figure 6:
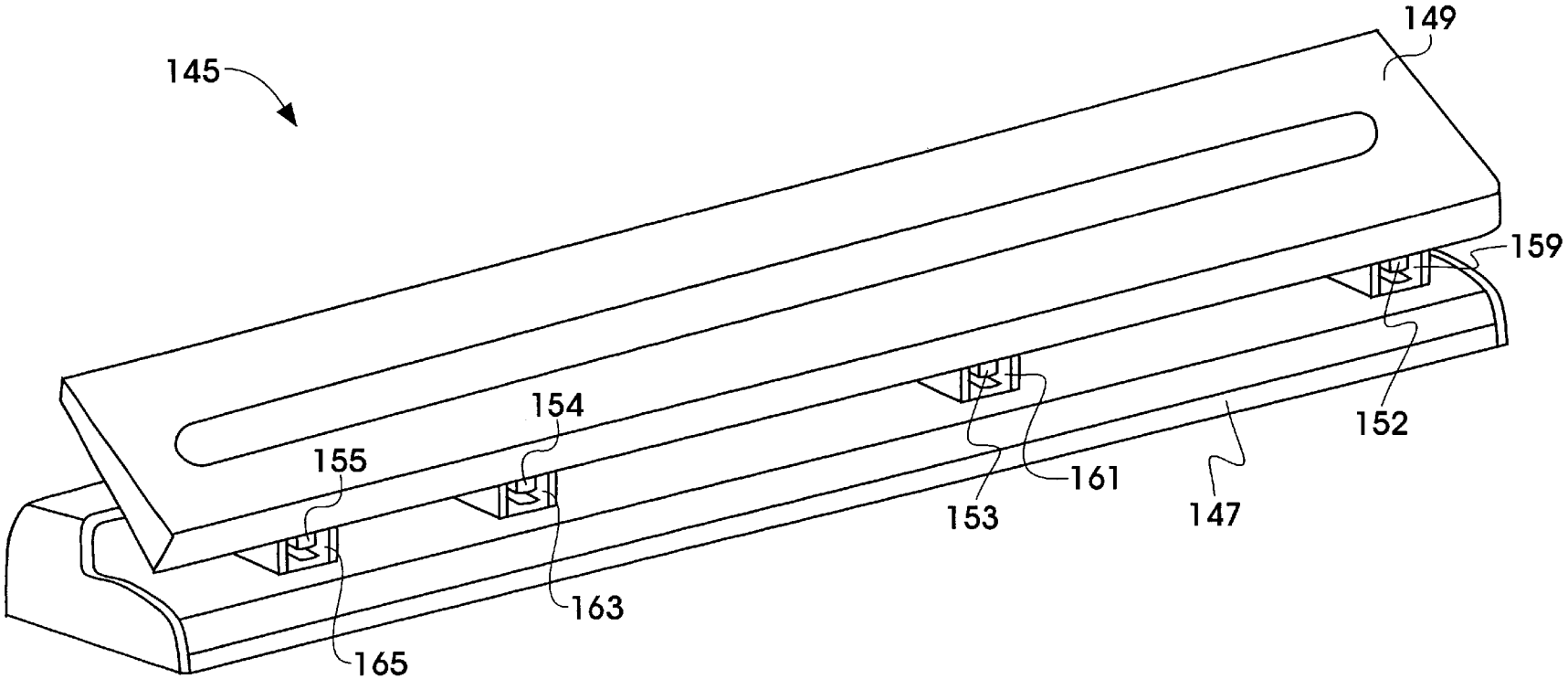
FIG. 6 shows an elongated desk-top punching system that can simultaneously create three standard punch outs for a three-ring binder in addition to the cutout of the invention.

A conventional paper punch uses three standard punch out punch heads and their corresponding dies to make three standard punch outs: first outer punch out, middle punch out, and second outer punch out. FIG. 6 shows paper punch 145, which is a punch head and die combination for making punch outs and cutouts of the invention.

To make the oversized sheet of paper of the invention, punch 145 has first outer punch head 152, middle punch head 153, and second outer punch head 154 and their corresponding dies, correctly positioned for making punch outs in paper that will be stored in a standard 8½ by 11 inch 3-ring binder. An additional cutout punch head 155 and its corresponding die create a cutout shape of the invention. First outer punch head 152, middle punch head 153, second outer punch head 154, and cutout punch head 155 and their corresponding dies are positioned by alignment means 159, 161, 163 and 165, respectively.

With a single motion of handle 149, the user causes the first outer punch head 152, middle punch head 153, second outer punch head 154 and cutout punch head 155 and their respective dies to work cooperatively to make the punch outs and cutout in an oversized sheet or sheets of paper that have been properly positioned in paper punch 145. In this way, both the punch outs and the cutout of the invention are created simultaneously.

The cutout, made by cutout punch head 155, in the non-standard portion of an oversized sheet or sheets of paper allows the paper be placed in a ring binder and folded 90 degrees relative to the binding edge and unfolded without interference from a ring of a ring binder or without the necessity of opening a binder ring.

Oversized sheet of paper 1 having keyhole cutout 5 (see FIGS. 1 & 2) may be created by using the cutout punch head and its corresponding die shown in FIG. 4 as cutout punch head 155 in paper punch 145. Oversized sheets of paper with other cutout shapes may be made with the cutout punch heads and their corresponding dies shown in FIG. 5.

Third Preferred Embodiment

Figure 7:
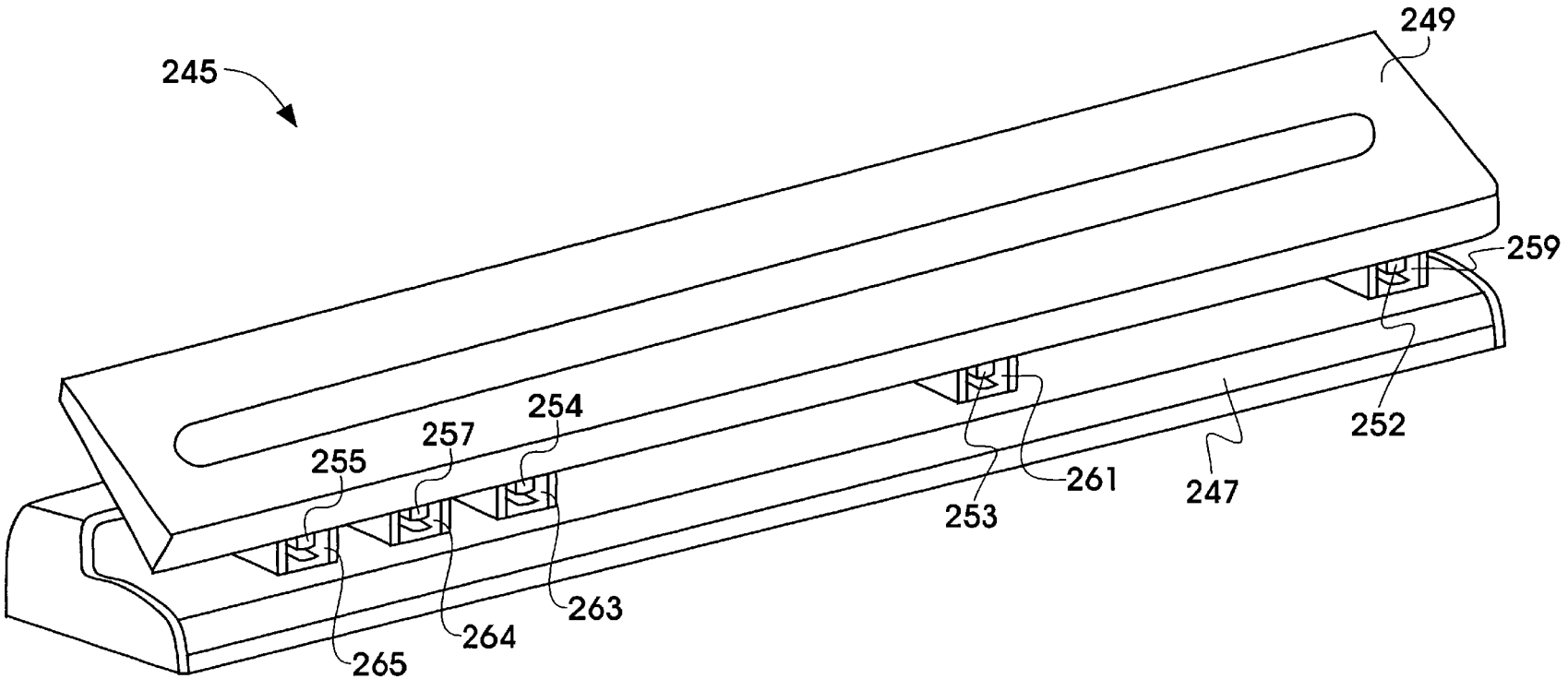
FIG. 7 shows desk-top punching system of FIG. 6, further including a fold line indicator punch head to indicate the fold line on an oversized sheet or sheets of paper.

FIG. 7 shows paper punch 245, which is a punch head and die combination for creating punch outs, cutouts and fold line indicator of the invention. Paper punch 245 functions similar to previously described paper punch 145.

Figure 8A:
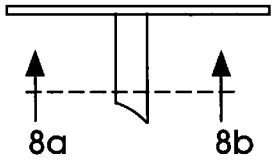
FIG. 8*a* shows a side view of the fold line indicator punch head shown in FIG. 8*a*.
Figure 8C:
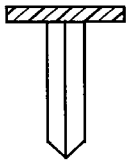
FIG. 8*c* is an end view of the fold line indicator punch head of FIG. 8*a*.
Figure 8B:
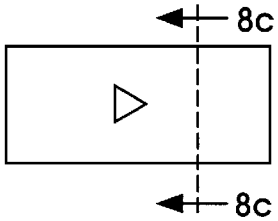
FIG. 8*b* shows a plan view of the fold line indicator punch head of FIG. 8*a*.
Figure 8D:
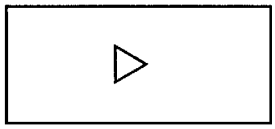
FIG. 8*d* shows the die corresponding to fold line indicator punch head shown in FIGS. 8*a, b* and *c*.

Oversized sheet of paper 1 having fold indicator means 9 (see FIG. 1) may be created by using the fold indicator punch head and its corresponding die (see FIG. 8) as fold indicator punch head 257 and its corresponding in paper punch 245. The punch head that makes notch fold line indicator 9 is shown in side view in FIG. 8*a*, plan view in FIG. 8*b* and in end view in FIG. 8*c*. FIG. 8*d* shows the plan view of the die that will create notch fold line indicator cutout 9 shown in FIG. 1.

To make the oversized sheet of paper of the invention punch 245 has first outer punch head 252, middle punch head 253, and second outer punch head 254 and their corresponding dies, correctly positioned for making punch outs in paper that will be stored in a standard 8½ by 11 inch 3-ring binder. An additional fold line punch head 257 and cutout punch head 255 and there corresponding dies create a fold line indicator and cutout, respectively, of the invention. First outer punch head 252, middle punch head 253, second outer punch head 254, fold line indicator punch head 257 and cutout punch head 255, and their corresponding dies are positioned by alignment means 259, 261, 263 264, and 265, respectively.

With a single motion of handle 249, the user causes the first outer punch head 252, middle punch head 253, second outer punch head 254, fold line indicator punch head 257, and cutout punch head 255 and their respective dies to work cooperatively to make the punch outs, fold line indicator, and cutout in an oversized sheet or sheets of paper that have been properly positioned in paper punch 245. In this way, both the punch outs, fold line indicator, and the cutout of the invention are created simultaneously.

The cutout, made by cutout punch head 255, in the non-standard portion of an oversized sheet or sheets of paper allows the paper be placed in a ring binder and folded, at fold line indicator 9, 90 degrees relative to the binding edge and unfolded without interference from a ring of a ring binder or without the necessity of opening a binder ring.

Fourth Preferred Embodiment

Figure 9:
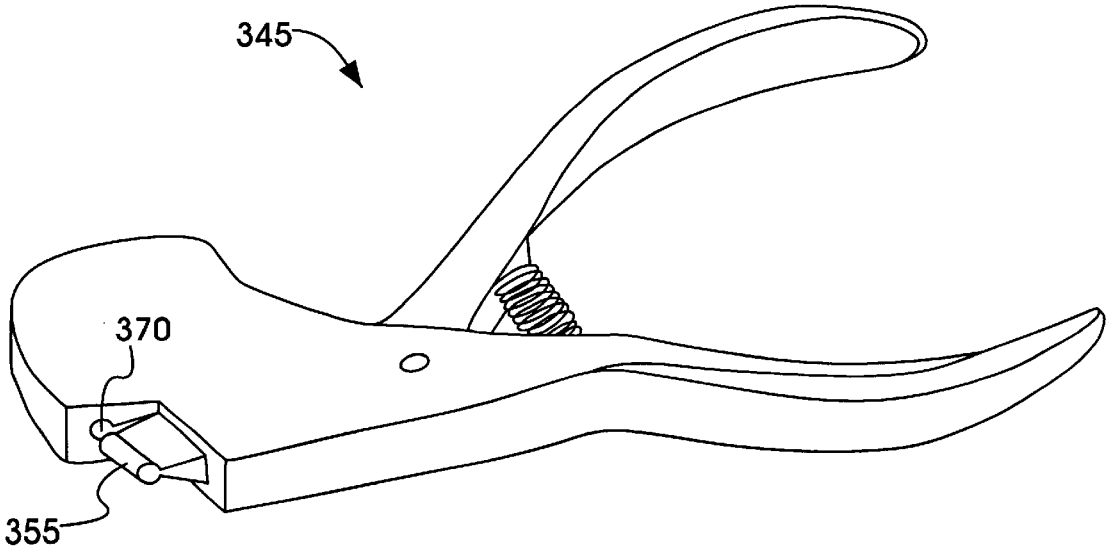
FIG. 9 shows a hand-held punching system that can create a single cutout of the invention, having a keyhole shape.

FIG. 9 shows a hand-held punch 345 having keyhole cut out punch head 355 and corresponding die 370. This hand-held punch can be used to create a keyhole cutout in an oversized sheet of paper not having the cutout. A hand-held punch may have any of the cutout punch heads shown in FIG. 3. Being hand-held, such a punch 345 would have use for those who handle paper already having the standard punch outs, and need only to add the cutout of the invention.

With respect to the above description then, it is to be realized that the optimum dimensional relationships for the elements of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A punch comprising:

a first punch out punch head and corresponding first punch out die which in cooperation make at least one punch out in a sheet through which a ring of a ring binder can pass;

a second punch out punch head and corresponding second punch out die which in cooperation make at least one punch out in a sheet through which a ring of a ring binder can pass;

at least one cutout punch head and corresponding cutout die which in cooperation form at least one cutout in a sheet;

said cutout punch head and said first and second punch out punch heads being positioned in a substantially collinear orientation.

2. The punch of claim 1 wherein said cutout is comprised of one of the following shapes: keyhole, oval, triangle, rectangle, curvilinear, corner cutout or slit.

3. The punch of claim 1 further comprising a fold line indicator punch comprising a fold line indicator punch head disposed between said second punch out punch head and said cutout punch head, and corresponding fold line indicator die disposed between said second punch out die and said cutout die.

4. The punch of claim 1 wherein said fold line indicator punch head and said fold line indicator die are in the shape of a notch.

5. A punch comprising:

a die body, a press body, a first outer punch head, a middle punch head, a second outer punch head, and a cutout punch head;

said die body and said press body being pivotally connected along a rocking axis with said punch heads operating therebetween;

said die body having a die base with a first outer die corresponding to said first outer punch head, a middle die corresponding to said middle punch head, a second outer die corresponding to said second outer punch head and a cutout die corresponding to said cutout punch head, and a sheet reception region between said dies and said punch heads;

wherein said punch heads and their corresponding dies are collinear and cooperate to make punch outs in a sheet thus enabling said sheet to be bound by the rings of a three ring binder;

wherein said cutout punch head and its corresponding die cooperate to make a cutout in an oversized sheet;

wherein said cutout punch head and cutout die are collinear with said punch heads and said corresponding dies, respectively;

whereby, when a fold is created in said oversized sheet 90 degrees relative to a binding edge, said cutout and said punch out are aligned allowing the oversized sheet to be bound in a ring binder but still folded and unfolded without opening a ring of the ring binder.

6. The punch of claim 5 wherein said cutout punch head is comprised of one of the following shapes: keyhole, oval, triangle, rectangle, curvilinear, corner cutout, slit.

7. The punch of claim 5 further comprising a fold line indicator punch.

8. The punch of claim 5 further comprising.

a fold line indicator punch head and a corresponding die disposed between said second outer punch Out head and said cutout punch head;

wherein said fold line indicator punch head and its corresponding die cooperate to make a fold line indicator in said oversized sheet.

9. The punch of claim 8 wherein said fold line indicator punch head has a notch shape.

10. A punch comprising:

a base and a press handle pivotally mounted on said base;

a first outer punch, a middle punch, and a second outer punch;

said first outer, middle and second outer punches mounted on said base in a three-hole punch configuration;

a cutout punch mounted on said base to the side of second outer punch opposite said middle punch;

wherein said first outer punch, said middle punch, said second outer punch and said cutout punch are positioned in a substantially collinear orientation;

said first outer, middle, second outer and cutout punches each including a gap for the receipt of at least one sheet of material;

wherein said press handle operably engages said first, middle, second outer and cutout punches;

wherein said first outer, middle and second outer punches create corresponding punch outs in said sheet of material when said press handle is operated to engage said first outer, middle and second outer punches;

wherein said cutout punch creates a cutout in said sheet of material when said press handle is operated to engage said cutout punch.

11. The punch of claim 10 wherein said cutout punch is positioned relative to said second other punch such that, when a fold is created in an oversized sheet 90 degrees relative to a binding edge thereof, said cutout and said punch out created by said second outer punch are aligned.

* * * * *